US005499868A

United States Patent [19]

Schainholz

[11] Patent Number: 5,499,868

[45] Date of Patent: Mar. 19, 1996

[54] SELF-SUPPORTING DATA PROCESSING DESK MODULE WITH DETACHABLE AND LONGITUDINALLY SHIFTABLE EXHAUST FAN ASSEMBLLY AND ADJUSTABLE ANGLE, REVERSIBLE VIDEO DECK BRIDGES WITH FRONT AND REAR CONTINUOUS SWEEP GROMMETS

[75] Inventor: Alfred Schainholz, Englewood, Fla.

[73] Assignee: Woodtronics, South Williamsport, Pa.

[21] Appl. No.: 298,752

[22] Filed: Aug. 31, 1994

[51] Int. Cl.[6] ..... A47B 77/08

[52] U.S. Cl. ..... 312/236; 454/230

[58] Field of Search ..... 312/213, 223.3, 312/236; 165/80.2, 47; 454/306, 230, 49

[56] References Cited

U.S. PATENT DOCUMENTS

| | | | |
|---|---|---|---|
| 4,776,317 | 10/1988 | Pinwon et al. | 312/236 |
| 4,784,445 | 11/1988 | Ott | 312/236 |
| 4,798,423 | 1/1989 | LaCour | 312/223.2 |
| 4,974,915 | 12/1990 | Bussard | 312/236 |
| 5,043,232 | 8/1991 | Helm et al. | 454/306 |
| 5,180,332 | 1/1993 | Mitchel et al. | 454/230 |
| 5,238,452 | 8/1993 | Levy et al. | 454/306 |
| 5,282,264 | 1/1994 | Reeves et al. | 312/236 |

*Primary Examiner*—James R. Brittain
*Assistant Examiner*—Gerald A. Anderson
*Attorney, Agent, or Firm*—Sughrue, Mion, Zinn, Macpeak & Seas

[57] ABSTRACT

A trading desk cluster of back-to-back, side-to-side paired desk modules employs a generally enclosed cabinet for mounting internally electronic data processing equipment, which develops high heat under load. The enclosed cabinet includes an apertured front wall for passage of cooling air and carries internally a fan assembly including a box-like plenum chamber, from which rises at the rear an upright outlet duct sized smaller than the open lower end of a vertical chimney at the rear of the desk. Tilting of the fan assembly permits the outlet duct to project vertically upward within the chimney and locked to the lower end thereof. The fan assembly is mounted on an angle bar for tilting and for supporting the fan assembly for sliding longitudinally to a position so as to overlie and be centered with the underlying processing equipment such as a CPU. A plurality of side-by-side flat video bridges are detachably interfitted between a rear edge of the desk top work surface and the back panel and extend coplanar with the desk top work surface. Each flat video bridge has at least one rectangular flat panel and a continuous brush-type sweep grommet extending lengthwise along at least one of front and rear edges of the panel. The bridges may be reversibly front-to-back mounted and may be hinged along one front or rear edge for adjustable oblique inclination of the bridge panels. The communication cables pass readily through the brush bristles of the grommets for facilitating connections between internal and external data processing equipment.

6 Claims, 6 Drawing Sheets

SELF-SUPPORTING DATA PROCESSING DESK MODULE WITH DETACHABLE AND LONGITUDINALLY SHIFTABLE EXHAUST FAN ASSEMBLLY AND ADJUSTABLE ANGLE, REVERSIBLE VIDEO DECK BRIDGES WITH FRONT AND REAR CONTINUOUS SWEEP GROMMETS

FIELD OF THE INVENTION

This invention relates to a trading desk cluster of back-to-back, side-to-side paired desk modules adapted to support data processing equipment housing a data processing central processing unit (CPU), and more particularly to an improved ventilation and cooling system for the CPU and highly versatile, adjustable and reversible type flat video bridge system for bridging the area between a front work surface and a slat wall back panel for each of the paired desk modules.

BACKGROUND OF THE INVENTION

Within recent years, modular desk and work stations have replaced individual desks at isolated locations for various office personnel. With the advent of data processing, the applicants have turned to open architecture modularity to the electronic office environment, using basic building blocks in the form of a self-supporting desk module containing a large wire plenum concealed from the user, but easily accessible for service, combined with an organizing back panel or slat wall to create an interactive work place, designed specifically to house internally and to display openly various components of the data processing system including keyboard, video display, central processing units and the like. One such modular work station takes the form of a trading desk, particularly useful in stock brokerage houses, which are capable of accommodating computer, monitor and telephone equipment, as well as cabling for electrical power, voice, signal, communication, data and fiber optics. Such trading desk cluster may be formed of back-to-back, side-to-side paired desk modules. The presence of the data processing equipment requires an initial work space at the front of the desk module, along with an extended coplanar surface area dedicated to facilitating the wiring passing internally within cabinet structures beneath the desk top at the work surface and a vertical rear wall, which rises upwardly from the level of the desk top to several feet above the same. Further, in such trading desk clusters, a significant portion of the electronic processing system is housed within the cabinet structure underneath the desk top, which normally extends within a foot well from one side of each desk module to the other.

Attempts have been made to facilitate both the passage of the communication system wiring and the cooling of the electronic equipment housed within the cabinet structure. Known systems for the passage of cables do not add to the ornamentality of the desk itself, but tend to detract from the same. Additionally, the heat loads, which are quite heavy during operation of the data processing equipment, create localized hot spots and the ventilation and cooling systems for the same have to a large extent been inadequate.

It is therefore a primary object of the invention to provide an improved self-supporting data processing desk module with detachable and longitudinally shiftable exhaust fan assemblies mounted internally of the cabinet structure and optimized positionwise with respect to the electronic processing equipment including the central processing units associated with such data processing systems and to the utilization of highly versatile, flat video bridges having single or double sweep grommets along one or both edges of single or multiple panel bridges, with the multiple panels being adjustable angularly, as well as reversible to create cable passages optimized to the location of the processing equipment on the desk top or to the rear thereof on the paired desk modules.

DESCRIPTION OF THE PREFERRED EMBODIMENTS

Figure 1:
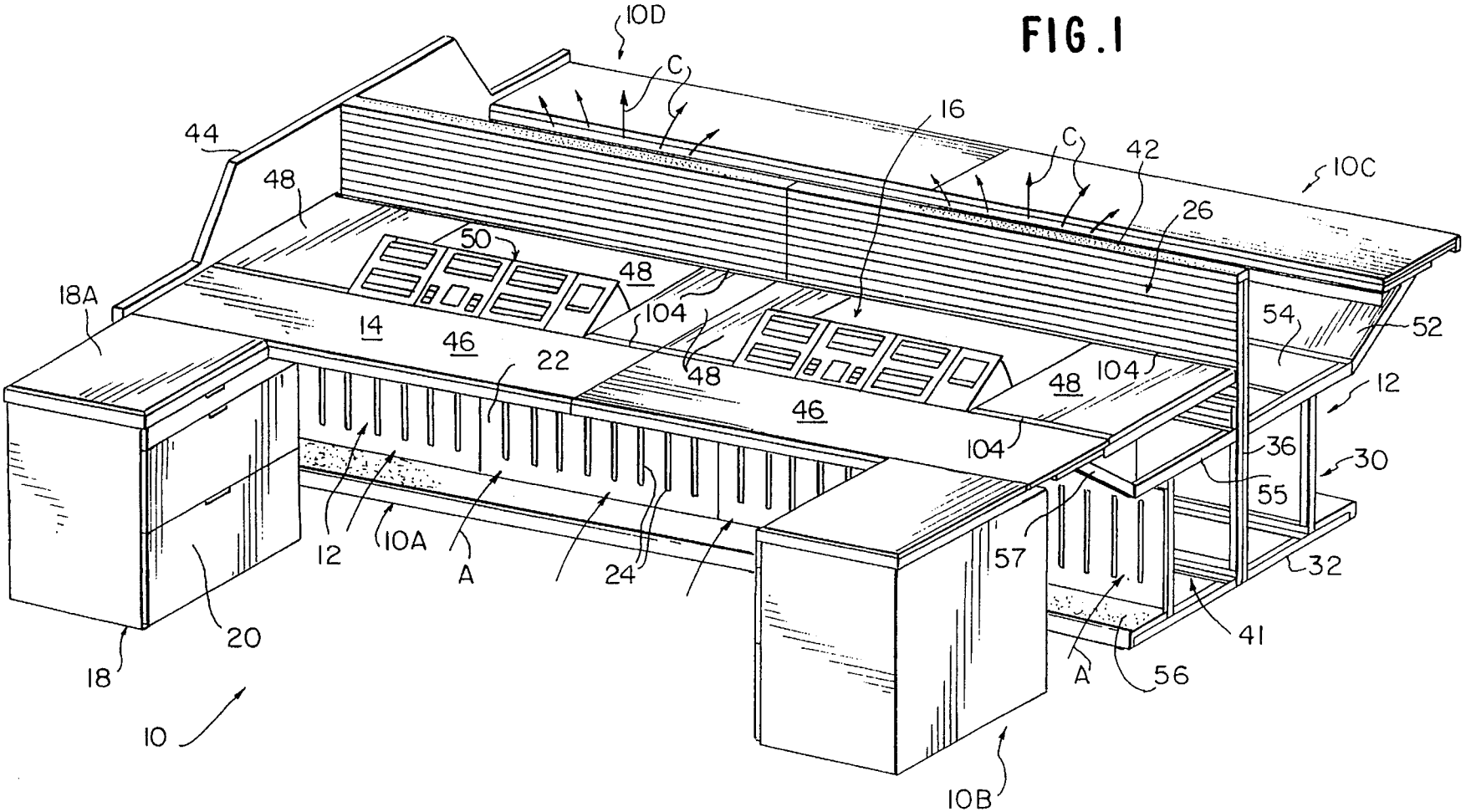
FIG. 1 is a perspective view of a trading desk cluster of back-to-back, side-to-side paired desk modules for supporting data processing equipment and housing internally central processing units and forming a preferred embodiment of the invention.
Figure 2:
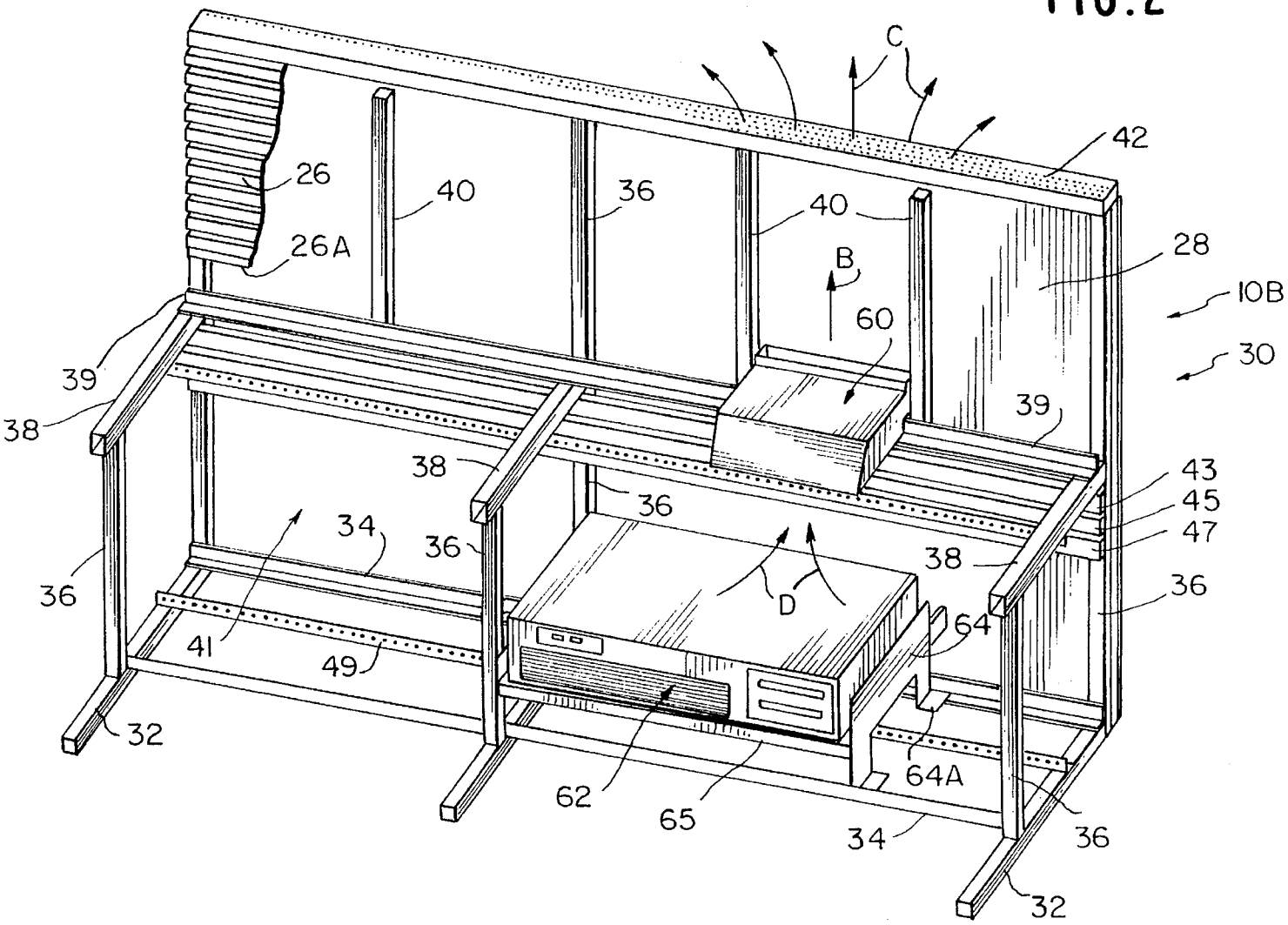
FIG. 2 is a perspective view of a portion of the trading desk cluster of FIG. 1, illustrating the improved, detachable and longitudinally slidable exhaust fan assembly associated with a central processing unit and forming one aspect of the present invention.
Figure 3:
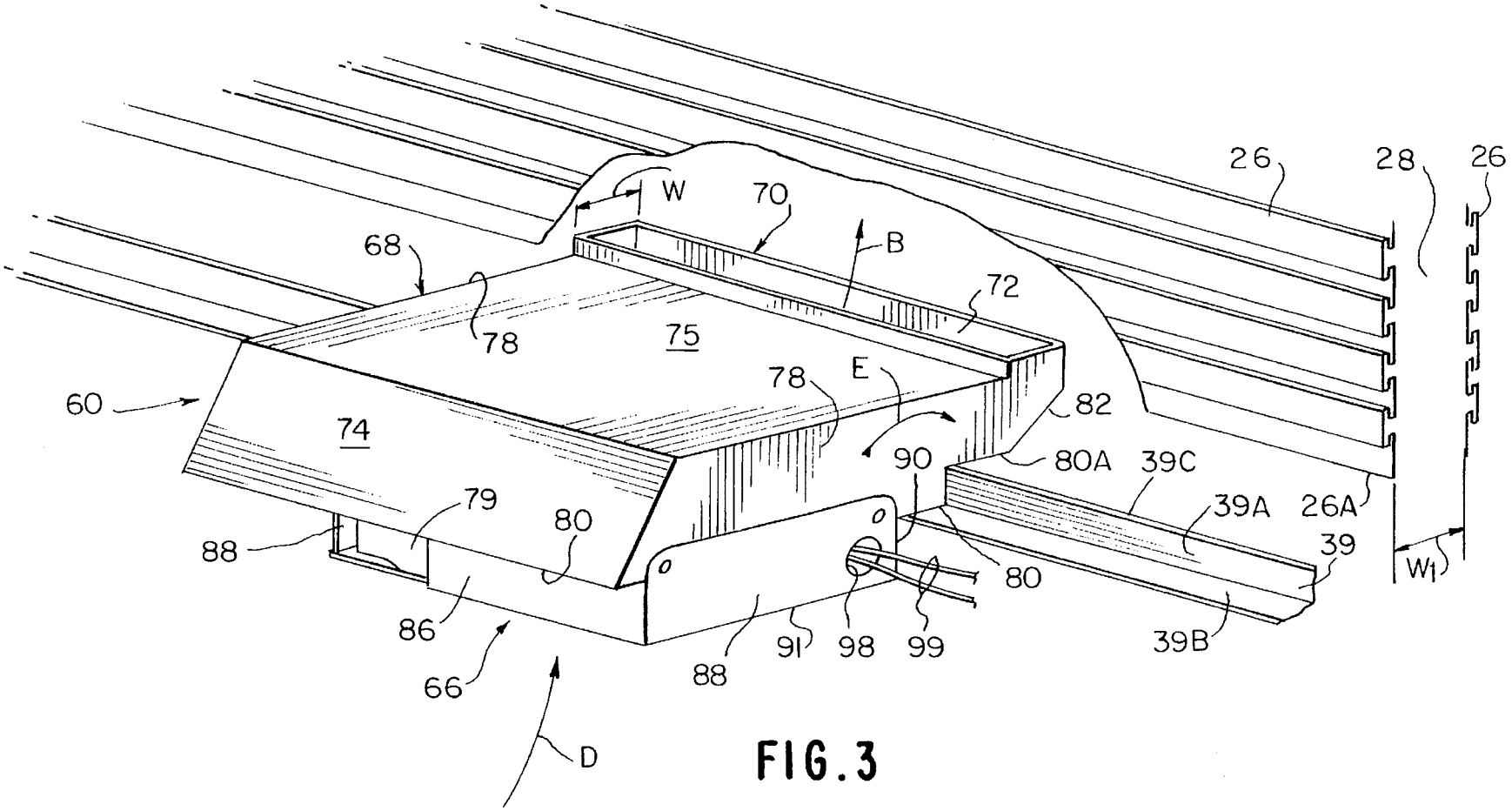
FIG. 3 is an enlarged perspective view of a portion of the apparatus of FIGS. 1 and 2 and illustrating the structural makeup of the exhaust fan assembly and its method of detachable mounting to the desk module supporting the same.

Referring to the drawings, FIGS. 1–3 are directed to a primary aspect of the present invention, specifically an improved ventilation system for cooling pieces of the electronic communication system mounted internally within a cabinet portion of a trading desk cluster indicated generally at 10 and formed of back-to-back, side-to-side paired desk modules 10A, 10B for a front pair and 10C, 10D for a rear or back pair. Each desk module includes a desk cabinet 12 supporting above and to the front of the cabinet, a desk work surface 14 spaced forwardly of a slat wall back panel 26 rising vertically upwardly to the rear of the cabinet 12. A deck indicated generally at 16 runs coplanar with the work surface 14, and to the front of the desk for each module there is provided a return indicated generally at 18, consisting of a pedestal 20 which mounts an overlying return top forming an extension of the work surface 14. The return 18 may have front to rear running drawers or side opening drawers. The cabinet 12 is principally formed of a cabinet front wall 22 provided with vertically oriented, longitudinally spaced ventilation slots permitting the entrance of cooling air as indicated by arrows A. The cabinet 12 and other portions of the desk modules 10A–10D are constructed of an open metal framework 30, which includes square, tubular, longitudinally spaced, transverse base beams 32, which support on their upper surfaces a plurality of front-to-rear spaced longitudinal beams or angle bars 34. Extending upwardly from the transverse base beams 32 are a number of vertical risers 36, which are of shorter height at the front of the cabinet and of larger height at the rear of the cabinet. The metal framework 30 additionally supports slat wall back panels 26, which partially define a ventilation chimney 28, through which the cooling air after passage over the electrical communication equipment internally within cabinet 12 at each desk module passes to escape through an overlying perforated metal top cap 42, FIG. 2. Where the trading desk cluster is at least two back-to-back desk modules, each of the back-to-back desk modules includes a slat wall back panel 26, which are separated horizontally from each other and which rise vertically to create a narrow, horizontally elongated vertical space principally forming the vertically upright chimney 28. Extending horizontally outwardly from the risers 36 are transverse desk top support beams at 38. The deck 16 is composed in FIG. 1 of a plurality of side-by-side, front and back, double-sweep grommet flat video bridges 48, these flat planar structures being spanning between the rear edge of the end-to-end abutting range desk top work surface panels 46 and the slat wall back panels 26 of respective desk modules. The details of such flat video bridges may be seen in drawing FIGS. 4–8, which will be described in detail hereinafter.

The position of transverse desk top support beams 38 may be better seen in FIG. 2, which is a cutaway of one of the desk modules 10B and particularly illustrating the nature in which the exhaust fan assembly 60 is detachably mounted to the open metal framework 30 beneath the level of the desk top work surface 14, and specifically beneath the deck 16 and within the interior of the cabinet 12. The nature of mounting and the adjustability longitudinally from one to the other of the cabinet 12 may be appreciated from the nature of makeup and positioning of the L-shaped angle bar 39, which has a vertical portion 39A, which abuts a rear riser 36 and an integral horizontal portion 39B, which rests upon the hollow rectangular tubes 38A constituting the transverse desk top support beams 38. The lower angle bars 34 function to assist the mounting of a central processing unit 62, along with vertical risers 36 and at least one bracket 64 of inverted U-shape having feet 64A, which are riveted or otherwise fixed to the horizontal portions of the angle bars 34 and which in turn support member or panel 65, upon which the CPU 62 is mounted. The CPU or other electronic data communication equipment, which gives off excessive heat during operation, is required either by way of convection or by forced air (fan or blower) to cause ventilation air entering the interior of the cabinet to pass over the equipment and cool the same in accordance with arrows D, FIG. 2. Such cooling air, which enters at A, FIG. 1, must be exhausted through the chimney 28. As may be appreciated, the invention has application to a single desk module such as 10A, 10B. In such case, either where two desk modules such as 10A and 10B are end-to-end joined in order to create a chimney, there is a requirement for a vertical wall behind, but closely adjacent to the slat wall back panels for a given desk module. In such case, the slat wall back panel 26 employed by a front-to-back cluster of desk modules is replaced by an imperforate vertical wall, which may be smooth and flat, but simply spaced by vertical risers or vertical partition studs 40. Such flat smooth rear wall is carried down to the transverse base beams 32.

Further, as seen in FIG. 1, horizontal transverse beams 55, projecting outwardly from the larger height vertical risers 36 at the rear of the desk module towards the returns 18, terminate short of the returns and are fixed to upwardly and forwardly oblique metal frame member 57, FIG. 1. As desired, the unit may include oblique underwalls 52, as well as flat horizontal underwalls 54, FIG. 1. The transverse base beams 32 extend to the front of the desk modules beyond the vertical front wall 22 of the cabinet 12 for each desk module, with a foot rest 56 extending the full length of the trading desk cluster 10. The illustrated embodiment of FIG. 1 through FIG. 3 forms a preferred embodiment of the invention, however, changes may be made to the open metal framework 30 to facilitate the creation of cabinet 12, and the returns 18 may be positioned either to the outside of the side-to-side paired desk modules, or to the inside, as desired. There is great flexibility with respect to the positioning and orientation of the contents of the desk, as well as the electronic equipment, either within the cabinet or to the rear of the desk top work surface 14 such as the data processing keyboard array 50.

Referring next to FIG. 3, this figure shows the nature of the detachable mounting of the exhaust fan assembly 60, the tilting of the assembly clockwise from the right, as indicated by arrow E, to effect proper positioning and gravity mount of the exhaust fan assembly 60, with the upright exhaust duct to the rear of the plenum chamber positioned within the lower end of the chimney, as defined by the lower edges 26A of the back-to-back slat wall back panels 26 of modules such as modules 10B, 10C. The exhaust fan assembly or unit 60, FIG. 3, constitutes a box like unit which is adapted to be manually positioned and gravity locked to ventilation chimney 28 by insertion of the upright exhaust duct 70 behind the slat wall back panel 26, with the exhaust duct functioning as the male member during insertion within the bottom of the chimney as defined by the two back-to-back slat wall back panels 26 of the front to rear aligned desk modules such as modules 10B, 10C.

The exhaust fan assembly or unit 60 includes an upper plenum chamber 68 and an underlying fan motor housing 66. The fan or plenum chamber 68 includes an upwardly and rearwardly oblique front wall 74, a horizontal top wall 75 terminating at the upright exhaust duct 70, laterally opposed sidewalls 78 and a bottom wall 80. Offset rearwardly is the underlying fan motor housing 66, including a front wall 86, laterally opposed sidewalls 88, a rear wall 90 and a bottom wall 91. An axial fan 79 is housed within the fan motor housing which drives a fan blade or blower (not shown) mounted within the fan housing 66. The fan motor housing 66 is offset rearwardly, and an inlet port 84 is formed within the front wall 80 of the fan motor chamber 66, receiving air drawn inwardly at the suction side of the fan as indicated by arrow D. Cooling air, drawn over each piece of electronic equipment, specifically CPU 62, and is discharged through the outlet port 72 of the upright exhaust duct and flows rapidly upwardly through a section of chimney 28, defined by laterally opposed partition studs 40 and slat wall back panels 26, FIG. 2. The rear end of the plenum chamber 68 has a bottom wall stepped at 80A, with the height of the step being equal to the height of the vertical portion 39A of the angle bar 39, with the bottom wall 80 of the plenum chamber resting on horizontal portion 39B of the angle bar. An oblique transition wall 82 extends from the stepped bottom wall 80A to the rear wall 76 of the plenum chamber, creating a reduced cross section flow of air at higher velocity within the rear portion of the plenum chamber, which flow enters the upright exhaust duct 70. The edge 39C of the vertical portion 39A of the angle bar 39 forms a fulcrum for pivoting of the exhaust fan assembly or unit 60. Thus, by tilting the rear portion of the unit 60 downwardly and raising the front portion of that unit, as indicated by arrow E, FIG. 3, the upright exhaust duct 70 may be slipped into the space between the angle bar 39 and the lower edge 26A of the adjacent slat wall back panel 26. The front of the exhaust fan assembly or unit 60 then is dropped or rotated counterclockwise opposite to the arrow E, and the upright exhaust duct 70 fits into the gap or space between the laterally opposed slat wall back panels 26 principally defining the chimney 28. Further, in accordance with FIG. 3, the exhaust fan assembly or unit may be shifted longitudinally along the angle bar 39, which acts as a rail. In accordance with FIG. 2, the presence of the risers 36 at the rear of the open frame 30 and the partition studs 40 limit such longitudinal movement. Absent partition studs 40, the exhaust fan assembly 60 may slide over the course of rail 39. A plurality of such exhaust fan assemblies or units 60 may be mounted to the desk 10 at various locations longitudinally within each of the desk modules 10A–10D. By using the partition studs 40, cooperating with the risers 36, five sections of the chimney 28 are isolated from each other, FIG. 2, facilitating the flow of cooling air, which enters the cabinets 22 of the various desk modules through slots 24 of the cabinet front walls 22 in accordance with arrows A, FIG. 1. The cooling air flows over and about the electronic equipment such as the CPU 62 within the equipment well 41 in accordance with arrows D, FIGS. 2 and 3, drawn by the suction created by the exhaust fan assembly 60. The air stream is discharged upwardly within the confined chimney sections as shown by arrows B, FIGS. 2, 3, and finally exhausted to the room through the perforated steel top cap 42, FIG. 2, as shown by arrows C.

The fan motor is energized from an electrical source (not shown) by wires 99 leading to the fan motor through a knock-out 98 within sidewall 88 of the fan motor housing 66. Preferably, the width W of the exhaust port 72 of the upright exhaust duct 70 is slightly less than the width $W_1$ of the chimney 28 between laterally spaced slat wall back panels 26 of the front-to-back desk modules.

Figure 4:
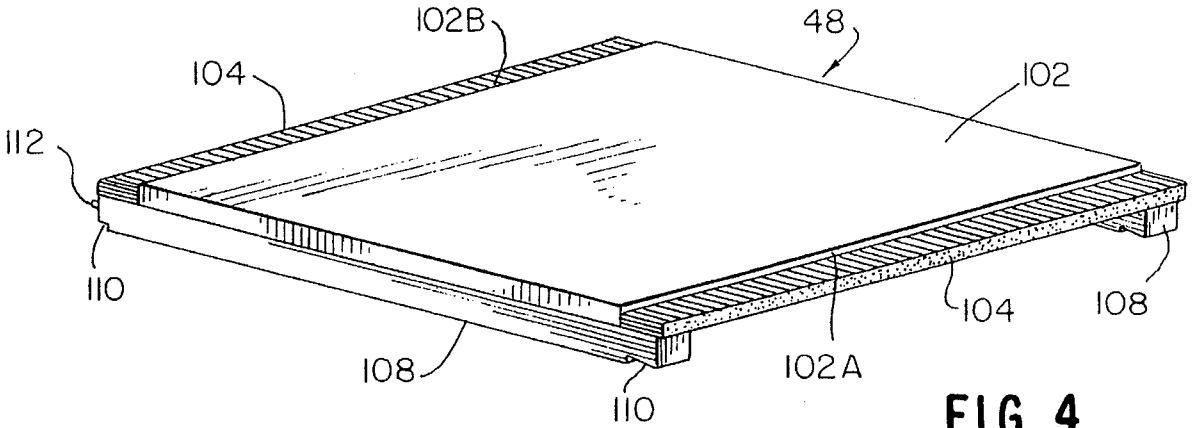
FIG. 4 is a perspective view of a front and back, double-sweep grommet flat video bridge forming one component of the trading desk cluster of FIGS. 1–3.

Referring next to FIGS. 1 and 4, a further aspect of the present invention involves in use of highly versatile flat video bridges or flat video decks such as double sweep grommet flat video bridges 48, FIG. 1, interposed at various locations between the work surface 16 of desk 10 and the slat wall back panels 26 of the respective desk modules 10A–10D.

FIG. 4 illustrates in an enlarged perspective view, the makeup of a double sweep grommet version of the flat video bridge 48 along front and back edges. Bridge 48 consists essentially of a rectangular panel board 102, duplicate fiber bristle continuous sweep grommets 104 along the front 102A and rear 102B edges of the panel board 102, with support and connection being effected by a pair of notched side mounting beams 108. Further, each of the side mounting beams 108 is provided with a tapered notch 110 at the front edge of the side mounting beams, and each includes a coaxial rear fixing pin 112 which extends beyond the continuous sweep grommet 104 and which penetrates a horizontal slot of the adjacent slat wall back panel 26 extending longitudinally from end of the desk 10 to the other. The front notches 110 at the front end of the side mounting beams 108 fit onto the horizontal portions of angle bars of the open metal frame work 30 for supporting the bridges 48, FIG. 4, at their front locations on underlying horizontal support members.

The grommets 104 are formed of plastic bristles of relatively fine diameter, with the bristles of the brush material strips thus formed being easily parted to permit the passage of optical fibers, electrical wires, coaxial cables and the like at any location and at the front of a bridge 48, adjacent the rear edge of a work surface 14, or to the rear of the data processing keyboards such as keyboards 50, FIG. 1. As may be seen in FIG. 1, the continuous sweep, brush form, grommets 104 extend the full length of the flat video bridge area of the desk 10 proximate to the slat wall back panels 26 and/or proximate to the work surface 14, except at the locations of the data microprocessing keyboards 50.

Figure 5:
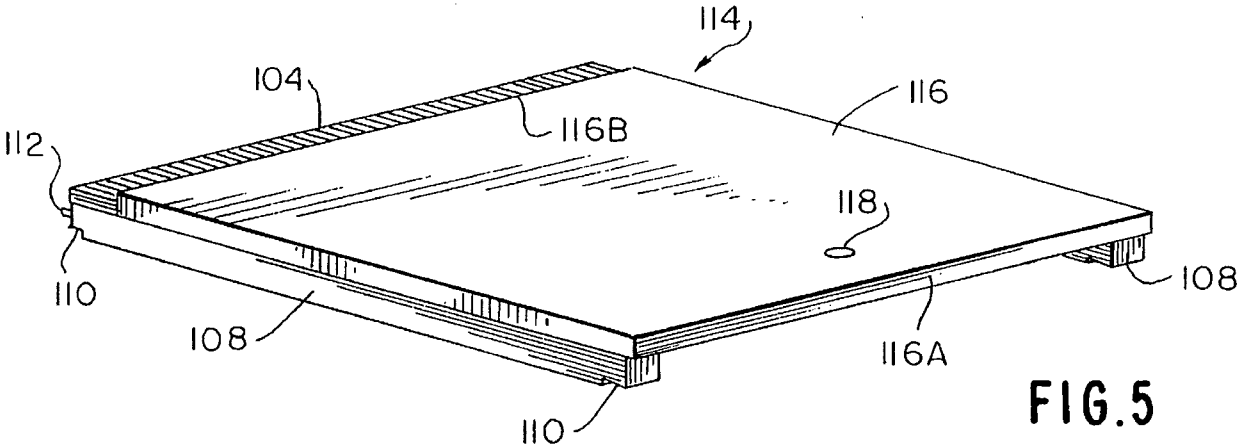
FIG. 5 is a perspective view of a single-sweep grommet flat video bridge forming an alternate embodiment of the invention.
Figure 6:
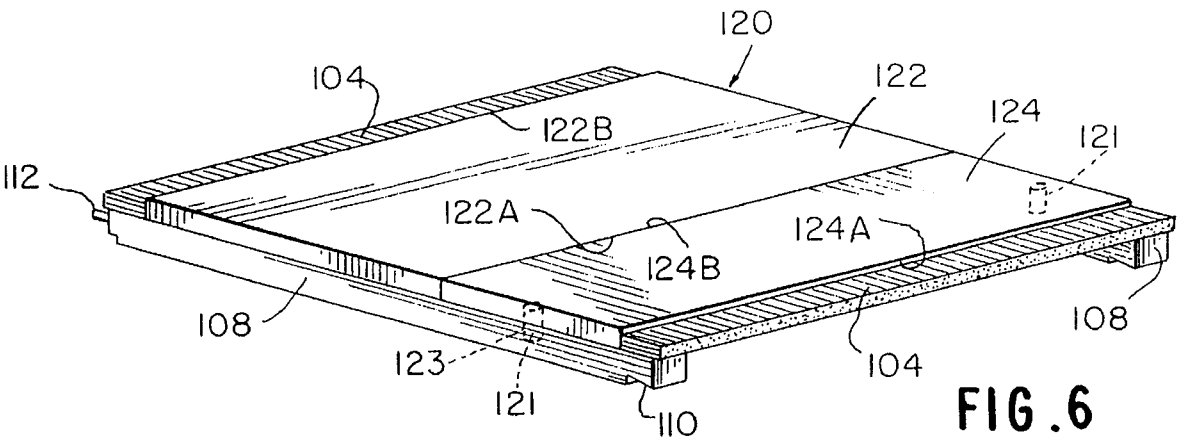
FIG. 6 is a perspective view of a reversible front panel, double-sweep grommet flat video bridge forming yet a further embodiment of the invention.
Figure 7:
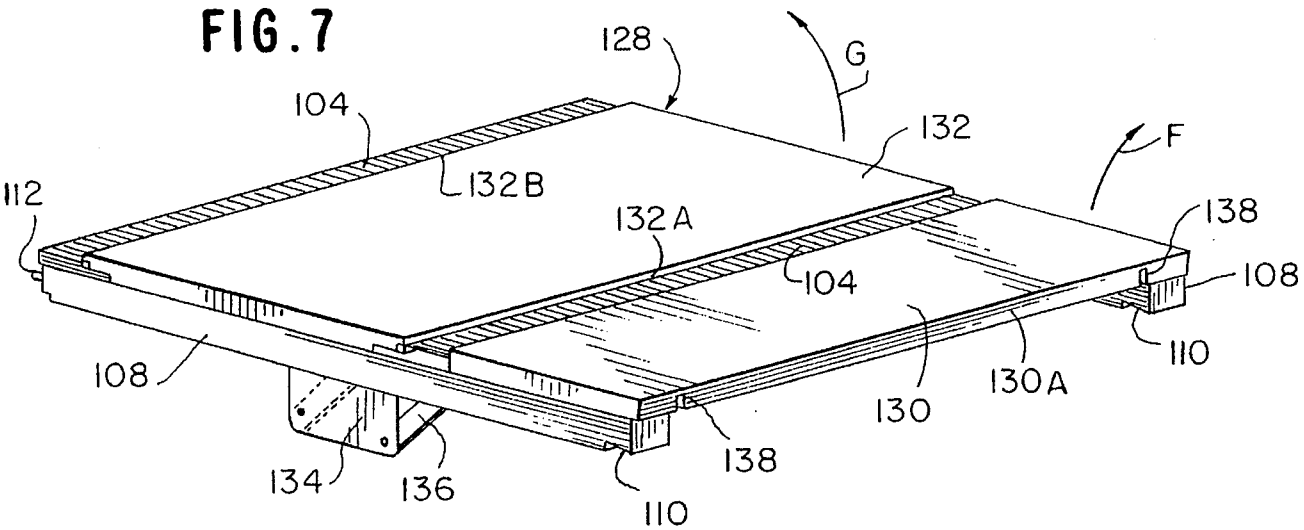
FIG. 7 is a perspective view of an adjustable front, adjustable back flat video bridge forming a further embodiment of the invention.
Figure 8:
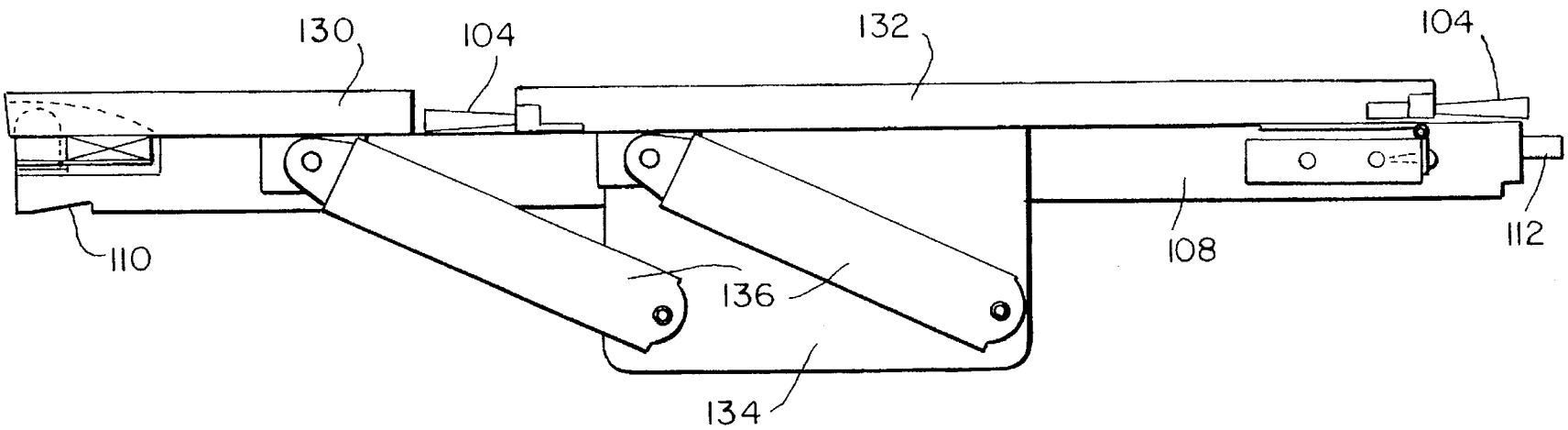
FIG. 8 is a side elevational view of the double-sweep adjustable back and front flat video bridge of FIG. 7, illustrating the extensible ratchet mechanism for adjusting the angle of the back and front panels and the hinging of the adjustable front panel of the flat video bridge of FIG. 7.

FIGS. 5, 6 and 7 show variations on a common theme of bridges involving sectional front and rear reversible panels with fiber bristle brushes along front and/or back edges and angularly adjustable back and/or rear panels. The basic components remain the same and in the various drawing FIGS. 4, 5, 6 and 7, with the same elements bearing same numeral designations.

Referring to FIG. 5, in a first variation, a one-sweep grommet flat video bridge indicated generally at 114 is comprised of a panel or planar board 116 of generally rectangular plan form, having a continuous sweep grommet or brush 104 at the rear edge 116B of the panel. The front edge 116A is devoid of such grommet. Side mounting beams 108 are provided in identical fashion to FIG. 4. The panel 116 includes pop-up pull 118 adjacent the front edge 116A of the panel 116 and centered side-to-side. The side beams 108 are notched at 110 at the front and provided with a rear fixing pin 112, as in the first embodiment.

Referring to FIG. 6, a double sweep front and rear panel flat video bridge 120 is comprised of a wide rear panel 122 positioned behind and in abutment with a narrow front panel 124. The rear panel 122 has a continuous sweep grommet 104 along a rear edge 122B, and a front edge 122A abutting a rear edge 124B of the front panel 124. The front edge 124A of the first panel is provided with a continuous sweep grommet 104. In this embodiment, the rear panel 122 is fixed on the longitudinally opposed side beams 108, while the front panel is reversibly mounted thereto. To facilitate reverse mounting at adjacent opposite sides of the front panel, there are provided pins 121 which project downwardly into approximately equal diameter bores 123 within the upper face of the beams 108 to both fix and maintain position of the front panel, whether the brush or grommet 124 faces forwardly as shown, or rearwardly towards the back panel. The pins 121 are so located as to ensure that the free edges of the brush bristles abut the front edge 122A of the rear panel when the front panel is reversed. The beams 108 are provided with front edge notches at 110 and rear fixing pins at 112 in accordance with the prior described embodiments.

FIG. 7 illustrates a further embodiment of the invention as an adjustable front, adjustable back, flat video bridge indicated generally at 128 comprising principally a front panel 130 and a back panel 132. The front panel 130 is devoid of a brush or continuous sweep grommet, while the back panel 132 has continuous sweep grommets 104 respectively along the front edge 128A and rear edge 128B of the panel. Both the front and back panels are angularly adjustable, that is the panels are hinged so that the front panel can be rotated adjacent to its front edge 130A so as to take a position upwardly and rearwardly oblique from that shown in FIG. 7 in accordance with arrow F. In contrast, the back panel 132 may be rotated about a horizontal pivot axis proximate to the rear edge 128B thereof, in an upwardly and forwardly oblique position as indicated by arrow G. To accomplish this action, one or both of the notched side mounting beams 108 are provided with a ratchet mount or bracket 134, from which a ratchet or ratchets 136 project. Notches 138 are provided within the front edge 130A of the front panel to receive hinges 140 which are concealed from the view and which hinge connect the front panel to the underlying supports beams 108. FIG. 7A shows in greater detail the ratchet mount, the ratchet, and the hinged connections for effecting angular adjustment of both the back panel 132 and the front panel 130 of this bridge 128.

From FIGS. 4–7, it is apparent that many variations in flat video bridges may be employed in making up multi work place trading desks or work stations such as that at 10, FIG. 1. In FIG. 1, in addition to the two-sweep grommet front and back flat video bridge 48, there may be substituted therefor, a one-sweep grommet flat video bridge 114 as per FIG. 5; a two-sweep grommet reversible front panel flat video bridge 120, as per FIG. 6; an adjustable front, adjustable back flat video bridge 128 in accordance with FIG. 7, as well as further variations. Specifically, the further variations may comprise a two-sweep grommet reversible front and adjustable back flat video bridge (not shown) or a two-sweep grommet adjustable front fixed back flat video bridge (not shown).

Finally, the flat video bridges which employ sectional panels, i.e., a front panel and a back panel, the continuous sweep grommets may extend along the front edge and rear edge of the back panel, or the front edge or the rear edge of the front panel. As such, the optical and electrical cables or wires may pass from the equipment well interiorly of the cabinet portion of the desk through the flat video bridge or deck surface area, just intermediate of the work surface as defined by panels 46 and the front edges of the flat video bridges, and for sectional bridges between the front and back panels of those bridges or decks.

Preferably, the exhaust fan assembly 60, FIG. 3, utilizes a pancake fan or blower fixedly mounted to the bottom wall 80 of plenum chamber 68. The pancake type fan may be a square axial fan having an axial outlet opening vertically upwardly directly into the interior of the plenum chamber 68. The square axial fan may be in the illustrated embodiment a $4^{11}/_{16}$ inch square fan under SA Model No. 52898 by the Dayton Corporation, providing 70 CFM, operating at 115 Volts at 2200 RPM.

As may be appreciated, the components of the trading desk or like apparatus may be formed of various materials such as wood, sheet steel, extruded steel or aluminum tubing, steel angle bars or the like.

Further, while the present invention has been described with reference to particular embodiments thereof, it will be understood that numerous modifications may be made by those skilled in the art without departing from the spirit and scope of the invention as defined in the appendant claims.

What is claimed is:

1. In a data processing desk comprising:

a generally enclosed cabinet for mounting internally electronic data processing equipment which develops high heat under load, said enclosed cabinet including an apertured wall for passage of cooling air into the interior of the cabinet, means comprising closely spaced vertical walls extending upwardly from the rear of said cabinet defining a vertical chimney and open at a lower end to the interior of said cabinet, the improvement comprising:

a fan assembly including a box like plenum chamber, an air inlet opening within a wall of said fan assembly proximate to said equipment, said plenum chamber including an upright outlet duct spaced from said air inlet and sized smaller than the open lower end of said chimney, means for supporting said plenum chamber within the interior of said cabinet with said outlet duct projecting vertically upwardly within said chimney at said lower end thereof, with a front face of said outlet duct abutting the lower end of one of said closely spaced vertical walls proximate to the apertured wall of said cabinet, whereby tilting of the plenum chamber about said support means permits the fan assembly to be detachably mounted within said cabinet and maintained by contact between said outlet duct and said vertical chimney, whereby operation of said fan assembly causes cooling air to enter the apertured wall of said cabinet to pass over and about said electronic processing equipment to be drawn into the fan assembly through said inlet and discharged vertically upwardly through said vertical outlet duct for passage through said chimney to efficiently cool said electronic data processing equipment.

2. The data processing desk as claimed in claim 1, wherein said support means comprises an angle bar extending longitudinally through said cabinet from one side to the other and being fixed to said cabinet, wherein said plenum chamber includes a stepped bottom wall in abutment with said angle bar, and said angle bar is spaced some distance below said closely spaced vertical walls such that a rear of said plenum chamber and said vertical upright outlet duct may be inserted into the lower end of said chimney, with said stepped bottom wall of said plenum chamber proximate to said angle bar and the plenum chamber tilted clockwise from a horizontal orientation thereof, and wherein said angle bar includes a vertically upright portion having an upper edge acting as a pivot axis for the stepped bottom wall of said plenum such that the plenum chamber after insertion of the vertical upright outlet duct into said chimney rotates counterclockwise to reposition the plenum chamber horizontally within the cabinet, with a front face of the vertical upright outlet duct in contact with the rear face of one of said spaced vertical walls defining said chimney to maintain the fan assembly in proper position with respect to the underlying electronic data processing equipment.

3. The data processing desk as claimed in claim 2, wherein the stepped bottom wall and the mass of the fan assembly is such that the fan assembly tends to rotate counterclockwise about the pivot axis defined by the angle bar to gravity seat the vertical upright outlet duct within the chimney and in contact with the spaced vertical wall proximate to said angle bar.

4. The data processing desk as claimed in claim 1, wherein said longitudinally extending angle bar extends lengthwise of the cabinet and constitutes a rail, whereby said fan assembly may be slid longitudinally along the rail to align the position of the fan assembly to that of the electronic data processing equipment to maximize cooling of the equipment during operation of the fan assembly.

5. The data processing desk as claimed in claim 1, further comprising a plurality of longitudinally spaced vertical reinforcing partition studs between said closely spaced vertical walls, separating said chimney into a plurality of side-by-side chimney sections, and wherein the width of the plenum chamber is sized to the longitudinal spacing between said upright reinforcing partition studs, thereby confining the flow of cooling air discharging from the outlet of said vertical upright outlet duct, thereby facilitating the flow of cooling air from the exterior through the apertured wall of the cabinet over the equipment and outwardly of said chimney section.

6. The data processing desk as claimed in claim 3, wherein said fan assembly includes a pancake axial fan mounted to the stepped bottom wall of said plenum chamber and to the side of said rail remote from said vertical upright outlet duct.

* * * * *